US005372986A

United States Patent [19]

Defieuw et al.

[11] Patent Number: 5,372,986

[45] Date of Patent: Dec. 13, 1994

[54] DYE-DONOR ELEMENT FOR USE ACCORDING TO THERMAL DYE SUBLIMATION TRANSFER

[75] Inventors: Geert Defieuw, Kessel-Lo; Rolf Wehrmann, Krefeld; Ralf Dujardin, Willich-Anrath; Knud Reuter, Krefeld, all of Germany

[73] Assignee: AGFA-Gevaert, N.V., Mortsel, Belgium

[21] Appl. No.: 61,523

[22] Filed: May 17, 1993

[30] Foreign Application Priority Data

Jun. 4, 1992 [EP] European Pat. Off. ..... 92201619.1

[51] Int. Cl.[5] ..... B41M 5/035; B41M 5/38

[52] U.S. Cl. ..... 503/227; 428/195; 428/412; 428/447; 428/480; 428/913; 428/914

[58] Field of Search ..... 8/471; 428/195, 913, 428/914, 412, 447, 480; 503/227

[56] References Cited

U.S. PATENT DOCUMENTS 4,981,748 1/1991 Kawai et al. ..... 428/216

FOREIGN PATENT DOCUMENTS 3833385 4/1990 Germany ..... 428/447

3833386 4/1990 Germany ..... 428/447

*Primary Examiner*—B. Hamilton Hess

*Attorney, Agent, or Firm*—Breiner & Breiner

[57] ABSTRACT

Dye-donor element for use according to thermal dye sublimation transfer comprising a support having on one side a dye layer and on the other side a heat-resistant layer, characterized in that said heat-resistant layer comprises a polyether containing at least 10 mol % recurring units corresponding to the following formula (I)

O—E—O—E'— (I)

wherein

—O—E—O— represents a divalent diphenolate radical corresponding to the following general formula (II)

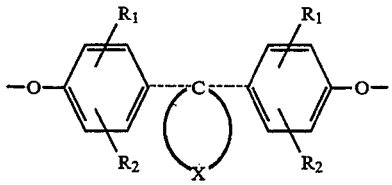

(II)

wherein $R_1$ and $R_2$ (same or different) represent hydrogen, halogen, a $C_1$–$C_8$ alkyl group, a $C_5$–$C_6$ cycloalkyl group, a $C_6$–$C_{10}$ aryl group or a $C_7$–$C_{12}$ aralkyl group; and X represents the necessary atoms to close a 5- to 8-membered cycloaliphatic ring which may be substituted with one or more $C_1$–$C_6$ alkyl groups or 5- to 6-membered cycloalkyl groups or carry fused-on 5- or 6-membered cycloalkyl groups;

—E'— represents a divalent radical of an aromatic sulfone corresponding to the following general formula (III)

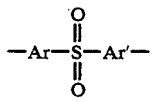

(III)

or a divalent radical of a diarylketone corresponding to the following general formula (IV)

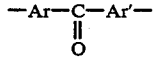

(IV)

or a divalent radical of benzonitrile corresponding to the following general formula (V)

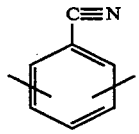

(V)

wherein Ar and Ar' in formula III and IV (same or different) represent difunctional aromatic radicals having 6 to 50 carbon atoms.

12 Claims, No Drawings

DYE-DONOR ELEMENT FOR USE ACCORDING TO THERMAL DYE SUBLIMATION TRANSFER

DESCRIPTION

1. Field of the Invention

The present invention relates to dye-donor elements for use according to thermal dye sublimation transfer and in particular to a heat-resistant layer of said dye-donor element.

2. Background of the Invention

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors, whereby dye from the selectively heated regions of the dye-donor element is transferred to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which is covered with a dye layer, which contains the printing dyes. Usually an adhesive or subbing layer is provided between the support and the dye layer.

Due to the fact that the thin support softens when heated during the printing operation and then sticks to the thermal printing head thereby causing malfunctioning of the printing apparatus and reduction in image quality, the backside of the support (side opposite to the dye layer) is typically provided with a heat-resistant layer to facilitate passage of the dye-donor element under the thermal printing head, An adhesive layer may be provided between the support and the heat-resistant layer.

The heat-resistant layer generally comprises a binder and optionally a lubricating material. In the conventional heat-resistant layers the binder is either a cured binder (as described in, for example, EP 153880, EP 194106, EP 314348, EP 329177, JP 60/151096, JP 60/229787, JP 60/229792, JP 60/229795, JP 62/48589, JP 62/212192, JP 62/259889, JP 01/5884, JP 01/56587, JP 02/128899) or a polymeric thermoplast (as described in, for example, EP 267469, JP 58/187396, JP 63/191678, JP 63/191679, JP 01/234292, JP 02/70485).

A disadvantage of cured binders is their cumbersome manufacture requiring relatively long curing times.

Polymeric thermoplasts known for use as binder for the heat-resistant layer such as i.a. Poly(styrene-co-acrylonitrile), polystyrene and Polymethylmethacrylate have the disadvantage of having a relatively low glass transition temperature (around 100° C.) leading to a relatively low heat stability of the heat-resistant layer containing said binder and therefore to unsatisfactory performance of said heat-resistant layer. Further when dye-donor elements having such heat-resistant layers have been rolled up and stored for any length of time such that the backcoat of one portion of the donor element is held against the dyecoat of another portion, sticking occurs between the backcoat and the dyecoat.

Aromatic polyethers such as polyether ketones, polyethersulfones and polycyanoarylethers based on bisphenol A are insoluble in common solvents and exhibit a relative low glass transition temperature (140° C. to 180° C.).

SUMMARY OF THE INVENTION

It is an object of the present invention to provide heat-resistant layers not having the disadvantages mentioned above.

According to the present invention, a dye-donor element for use according to thermal dye sublimation transfer is provided, said dye-donor element comprising a support having on one side a dye layer and on the other side a heat-resistant layer, characterized in that said heat-resistant layer comprises a polyether containing at least 10 mol % of the recurring structural unit corresponding to formula (I)

$$-O-E-O-E'- \quad (I)$$

wherein

—O—E—O— represents a divalent diphenolate radical corresponding to the following general formula (II)

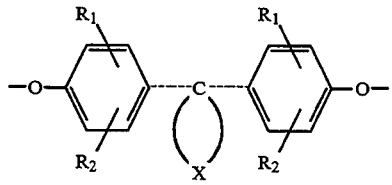

(II)

wherein $R_1$ and $R_2$ (same or different) represent hydrogen, halogen, a $C_1$–$C_8$ alkyl group, a $C_5$–$C_6$ cycloalkyl group, a $C_6$–$C_{10}$ aryl group or a $C_7$–$C_{12}$ aralkyl group; and X represents the necessary atoms to close a 5- to 8-membered cycloaliphatic ring which may be substituted with one or more $C_1$–$C_6$ alkyl groups or 5- to 6-membered cycloalkyl groups or carry fused-on 5- or 6-membered cycloalkyl groups;

—E'— represents a divalent radical of an aromatic sulfone corresponding to the following general formula (III)

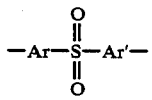

(III)

or a divalent radical of a diarylketone corresponding to the following general formula (IV)

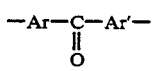

(IV)

or a divalent radical of benzonitrile corresponding to the following general formula (V)

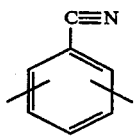

(V)

wherein Ar and Ar' in formula III and IV (same or different) represent difunctional aromatic radicals having 6 to 50 carbon atoms.

The polyethers for use according to the present invention have higher glass transition temperatures (typically in the range of 160° C. to 250° C.) than polyethers derived from bisphenol A due to the presence of a cycloaliphatic group in the diphenolate radical. Moreover, said polyethers are soluble in ecologically acceptable solvents such as ketones.

Heat-resistant layers comprising polyethers of the present invention exhibit high heat stability and a low friction coefficient at higher temperatures (and thus no occurrence of 'smiles' resulting from the wrinckling of the dye-donor element while passing under the thermal head) and don't stick to the dye layer when the dye-donor element is stored in a rolled form.

DETAILED DESCRIPTION OF THE INVENTION

Preferably one to two carbon atoms of X in formula (II), more preferably only one carbon atom, is dialkyl substituted. A preferred alkyl group is methyl; preferably the carbon atoms in Alpha-position to the diphenyl-substituted C-atom are not dialkyl substituted; alkyl disubstitution in Beta-position is preferred.

Preferred examples of diphenolate radicals —O—E—O— for use according to the present invention are those with 5- or 6-membered cycloaliphatic rings. Examples of such diphenolate radicals are given below.

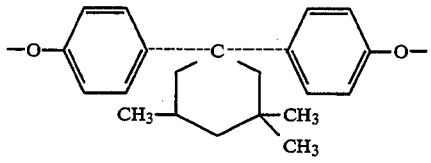
(VI)

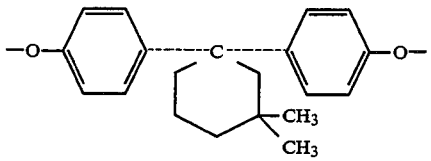
(VII)

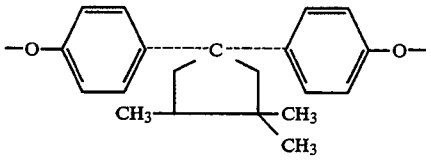
(VIII)

A particularly preferred diphenolate is the diphenolate radical derived from 1,1-bis-(4-hydroxyphenyl)-3,3,5-trimethylcyclohexane (formula (VI)).

The bis-(hydroxyphenyl)-cycloalkanes used for obtaining the diphenolate radical corresponding to formula (II) can be prepared according to a known method by condensation of phenols corresponding to formula (IX) and ketones corresponding to formula (X)

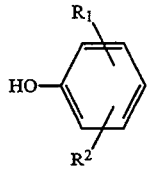
(IX)

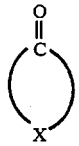
(X)

wherein $R^1$, $R^2$ and X have the same significances as given to them in formula (II).

The phenols corresponding to formula (IX) are known compounds or can be prepared according to known methods (see, for example, for cresols and xylenols Ullmanns Encyklopädie der technischen Chemie 4. neubearbeitete und erweiterte Auflage, Band 15, pages 61 to 77, Verlag Chemie-Weinheim-New York 1978; for chlorophenols Ullmanns Encyklopädie der technischen Chemie 4. Auflage, Band 9, pages 573 to 582, Verlag Chemie 1975; and for alkylphenols Ullmanns Encyklopädie der technischen Chemie 4. Auflag, Band 18, pages 191 to 214, Verlag Chemie 1979 ).

Examples of suitable phenols corresponding to formula IX are: phenol, o-cresol, m-cresol, 2,6-dimethylphenol, 2-chlorophenol, 3-chlorophenol, 2,6-dichlorophenol, 2-cyclohexylphenol, diphenylphenol and o- or p-benzylphenol.

Ketones corresponding to formula (X) are known compounds, see for example Beilsteins Handbuch der Organischen Chemie, 7. Band, 4. Auflage, Springer-Verlag, Berlin, 1925 and corresponding Ergänzungsbände 1–4; Journal of American Chemical Society, Vol. 79 (1957), pages 1488, 1490 and 1491; U.S. Pat. No. 2,692,289; Journal of Chemical Society, 1954, pages 2186 and 2191; Journal of Organic Chemistry, Vol. 38, No. 26, 1973, page 4431; Journal of American Chemical Society, Vol. 87, 1965, page 1353 (especially page 1355). A general method for preparing ketones corresponding to formula (X) is described in, for example, Organikum, 15. Auflage, 1977, VEB-Deutscher Verlag der Wissenschaften, Berlin, page 698.

Examples of suitable ketones corresponding to formula (X) are:

3,3-dimethylcyclopentanone, 2,2-dimethylcyclohexanone, 3,3-dimethylcyclohexanone, 4,4-dimethylcyclohexanone, 3-ethyl-3-methylcyclopentanone, 2,3,3-trimethylcyclopentanone, 2,4,4-trimethylcyclopentanone, 3,3,4-trimethylcyclopentanone, 3,3-dimethylcycloheptanone, 4,4-dimethylcycloheptanone, 3-ethyl-3-methylcyclohexanone, 4-ethyl-4-methylcyclohexanone, 2,3,3-trimethylcyclohexanone, 2,4,4-trimethylcyclohexanone, 3,3,4-trimethylcyclohexanone, 2,5,5-trimethylcyclohexanone, 3,3,5-trimethylcyclohexanone, 3,4,4-trimethylcyclohexanone, 2,3,3,4-tetramethylcyclopentanone, 2,3,4,4-tetramethylcyclopentanone, 3,3,4,4-tetramethylcyclopentanone, 2,2,5-trimethylcycloheptanone, 2,2,6-trimethylcycloheptanone, 2,6,6-trimethylcycloheptanone, 3,3,5-trimethylcycloheptanone, 3,5,5-trimethylcycloheptanone, 5-ethyl-2,5-dimethylcycloheptanone, 2,3,3,5-tetramethylcycloheptanone, 2,3,5,5-tetramethylcycloheptanone, 3,3,5,5-tetramethylcycloheptanone, 4-ethyl-2,3,4-trimethylcyclopentanone, 2-isopropyl-4,4-dimethylcyclopentanone, 4-isopropyl-2,4-dimethylcyclopentanone, 2-ethyl-3,5,5-trimethylcyclohexanone, 3-ethyl-3,5,5-trimethylcyclohexanone, 3-ethyl-4-isopropyl-3-methyl-cyclopentanone, 4-s-butyl-3,3-dimethylcyclopentanone, 2-isopropyl-3,3,4-trimethylcyclopentanone, 3-ethyl-4-isopropyl-3-methyl-cyclohexanone, 4-ethyl-3-isopropyl-4-methylcyclohexanone, 3-s-butyl-4,4-dimethylcyclohexanone, 3-isopropyl-3,5,5-trimethylcyclohexanone, 4-isopropyl-3,5,5-trimethylcyclohexanone, 3.3,5-trimethyl-5-propylcyclohexanone, 3,5,5-trimethyl-5-propylcyclohexanone, 2-butyl-3,3,4-trimethylcyclopentanone, 2-butyl-3,3,4-trimethylcyclohexanone, 4-butyl-3,3,5-trimethylcyclohexanone, 3-isohexyl-3-methylcyclohexanone, 5-ethyl-2,4-diisopropyl-5-methylcyclohexanone, 2,2-dimethylcyclooctanone, and 3,3,8-trimethylcyclooctanone.

Examples of preferred ketones are:

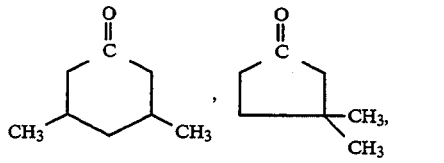

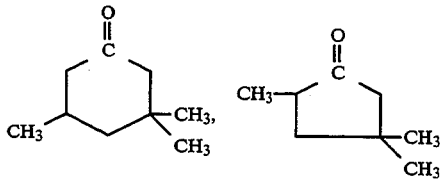

and

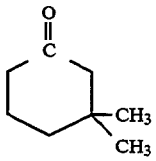

The synthesis of suitable diphenols is described in e.g. DE 3832396.

The divalent diphenolate radicals corresponding to the general formula II are introduced in the polyethers of the present invention by reaction of dialkali metal diphenolates $$Z—O—E—O—Z \qquad XI$$

wherein Z represents an alkali metal; with aromatic dihalogenated compounds which can be selected from the group of dihalogenated diarylsulfones (XII)

$$Y—Ar—SO_2—Ar'—Y \qquad (XII)$$

or from the group of dihalogenated diarylketones (XIII)

$$Y—Ar—\underset{\underset{O}{\|}}{C}—Ar'—Y \qquad (XIII)$$

or the group of dihalogenbenzonitriles (XIV)

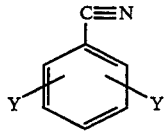

(XIV)

wherein Y in formula (XII), (XIII) and (XIV) represent a halogen atom and wherein Ar and Ar' in formula (XII) and (XIII) (same or different) represent difunctional aromatic radicals having 6 to 50 carbon atoms.

Sodium or potassium is preferably the alkali metal Z in the dialkali metal diphenolates (XI).

Chlorine or fluorine, in particular chlorine is preferably the halogen atom Y in the dihalogenated compounds (XII) and (XIV). Fluorine is preferred for (XIII).

Examples of dihalogenated diarylsulfones (XII) are e.g.

4,4'-dichlorodiphenyl-sulphone,
4,4'-difluorodiphenyl-sulphone,
4-chloro-4'-fluorodiphenyl-sulphone,
3,3'-dinitro-4,4'-dichlorodiphenyl-sulphone,
3,3'-dinitro-4,4'-difluorodiphenyl-sulphone,
4,4'-dibromodiphenyl-sulphone,

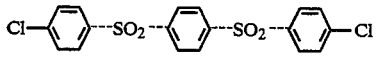

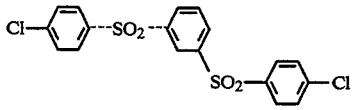

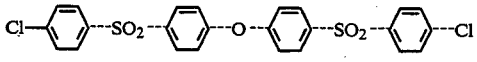

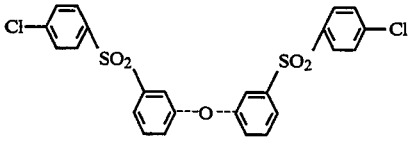

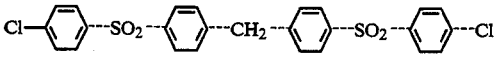

By reaction of dihalogenated diarylsulfones (XII) with the dialkali metal salts of the diphenolate (XI), a polyether sulfone is obtained. Polyether sulfones for use according to the present invention are described in DE 3833385.

Preferred polyether sulfones according to the present invention derived from dihalogenated diarylsulfones are those which contain at least 10 mol % of the following recurring unit

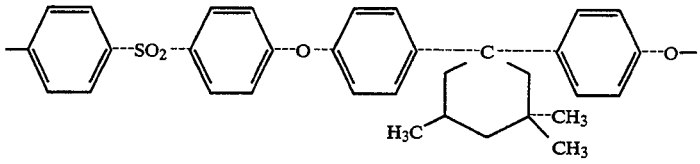

and have a molecular weight (weight-average) of more than 3000 g/mol.

Examples of dihalogenated diarylketones (XIII) are:

4,4'-dichlorobenzophenone
4-chloro-4'-fluorobenzophenone
4,4'-difluorobenzophenone
4,4'-dichloroterephthalophenone:

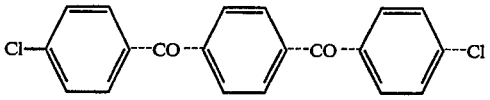

4,4'-difluoroterephthalophenone:

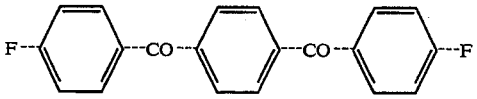

4,4'-dichloro-isophthalophenone:

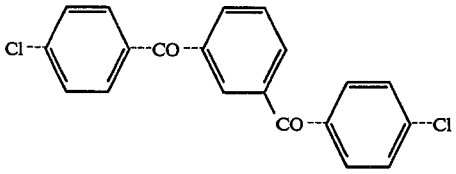

4,4'-difluoro-isophthalophenone:

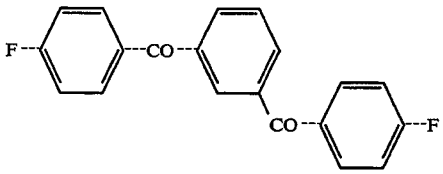

4,4'-bis-(p-chlorobenzoyl)-diphenyl ether:

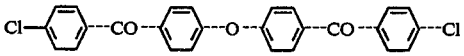

4,4'-bis-(p-fluorobenzoyl)-diphenyl ether:

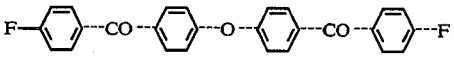

3,3'-dinitro-4,4'-dichlorobenzophenone
3,3'-dinitro-4,4'-difluorobenzophenone
4,4'-bis-(p-chlorobenzoyl)-biphenyl

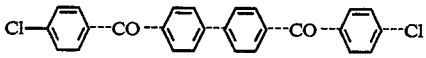

4,4'-bis-(p-fluorobenzoyl)-biphenyl:

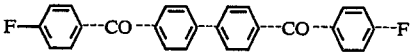

2,8-bis-(p-chlorobenzoyl)-diphenylene oxide:

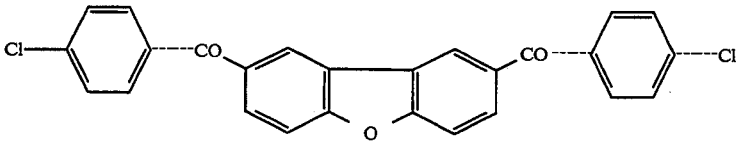

and 4,4-bis-(p-halogenobenzoyl)-diphenylmethane derivatives:

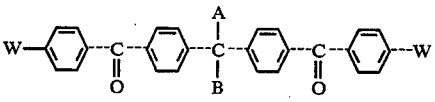

wherein A and B, which may be the same or different, represent $C_1$–$C_9$ aliphatic, $C_5$–$C_6$ cycloaliphatic, $C_6$–$C_{10}$ aromatic or $C_7$–$C_{12}$ araliphatic radicals or hydrogen; and W represents a halogen atom e.g.

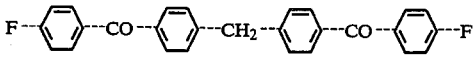

By reaction of dihalogenated diarylketones (XIII) with the dialkali metal salts of the diphenolate (XI), a polyether ketone is obtained. Polyether ketones for use according to the present invention are described in U.S. Pat. No. 4,964,890.

Preferred polyether ketones according to the present invention are those which contain at least 10 mol % recurring structural units corresponding to the following general formula:

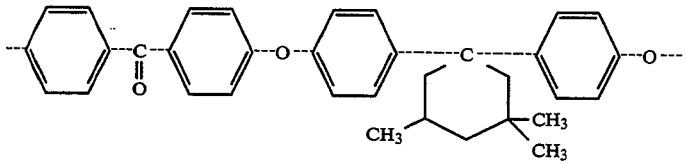

and have a molecular weight of more than 3000 g/mol (weight-average).

Examples of dihalogen benzonitriles (XIV) are e.g. 2,6-dichlorobenzonitrile, 3,5-dichlorobenzonitrile, 2,3-difluorobenzonitrile, 2,4-difluorobenzonitrile, 2,5-difluorobenzonitrile, 2,6-difluorobenzonitrile, 3,4-difluorobenzonitrile, 3,5-difluorobenzonitrile.

The use of 2,6-dichlorobenzonitrile is especially preferred.

By reaction of dihalogenated dihalogenbenzonitriles (XIV) with the dialkali metal salts of the diphenolate (XI), a polycyanoarylether is obtained.

Preferred polycyanoarylethers are those which contain at least 10 mol % recurring structural units corresponding to the following general formula

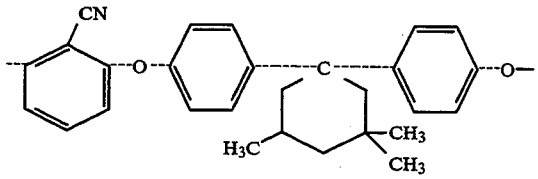

and have a molecular weight of more than 3000 g/mol (weight average).

The aromatic polyethers according to the present invention may be prepared, for example, by reaction of dialkali metal salts of diphenolates with the dihalogenated aromatic compounds described above, in a polar solvent, the polar solvent employed preferably being caprolactam which is $C_1$–$C_5$ alkyl-substituted on the nitrogen, such as N-methyl-caprolactam, N-ethyl-caprolactam, N-n-propyl-caprolactam or N-isopropyl-caprolactam, preferably N-methyl-caprolactam, or pyrrolidones which are $C_1$–$C_5$ alkyl-substituted on the nitrogen, such as N-methyl-pyrrolidone, or N,N-dimethyl-formamide, N,N-dimethylacetamide, dimethyl-sulphoxide, diphenyl-sulphone, sulpholane and tetramethylurea. A proportion, e.g. from 0.1 to 200 wt %, based on the weight of the polar solvent, of other less polar solvents may be used simultaneously, e.g. aromatic hydrocarbons, such as toluene, xylene, mesitylene or chlorobenzene, or aliphatic hydrocarbons, such as benzine or cyclohexane.

In the preparation of the polyethers for use according to the present invention a branching agent may be used. Small amounts, preferably between 0.05 and 2.0 mole % (with respect to the diphenolates) of tri- or higher functional compounds, in particular compounds with three or more phenolic groups, are added in order to obtained branched polyethers. Typical examples of branching agents are components with three or more phenolic groups such as phloroglucine and 1,3,5-tri-(4-hydroxyl-phenyl)-benzene.

The aromatic polyethers according to the present invention may be prepared at temperatures of from 120° to 320° C., preferably from 135° C. to 280° C., under pressures of from 0.8 to 10 bar, preferably from 1 to 3 bar, in particular under ambient atmospheric pressure.

The molar ratio of the dialkali metal diphenolates and the aromatic dihalogenated compounds is from 0.5:1 to 2:1, preferably from 0.8:1 to 1.2:1, more preferably from 0.95:1 to 1.05:1, it being necessary to choose a ratio of 1:1 or very close to 1:1 for high molecular weights.

The amount of polar solvents is from 0.5 to 50, preferably from 2 to 20 parts, by weight, based on the total weight of the components which form the polyether.

The polyethers according to the present invention may be obtained from the resulting reaction mixtures as follows:

The reaction mixture is diluted, especially if very highly viscous solutions are present, e.g. with the polar reaction solvent or another solvent for the polyether and is filtered. After neutralization of the filtrate with a suitable acid, e.g. acetic acid, the polyether is precipitated by pouring into a suitable precipitation medium, e.g. water, alcohols (such as methanol or isopropanol) or water-alcohol mixtures, e.g. $H_2O$/methanol 1:1, and is isolated and then dried.

Polyethers of the present invention are used as binder in the heat-resistant layer of the dye-donor element according to the present invention in an amount of at least 10% by weight, preferably in an amount from 30 to 100% by weight. A mixture of two or more of said polyethers can also be used in the heat-resistant layer.

Polycyanoarylethers are especially preferred for use in a heat-resistant layer, since these compounds exhibit a good solubility in solvents such as ketones, more specifically in aceton and ethylmethylketon.

In addition to said polyethers, the heat-resistant layer of the dye-donor element according to the present invention can also contain one or more of the conventional thermoplastic binders for heat-resistant layers such as poly(styrene-co-acrylonitrile), poly(vinylalcohol-co-butyral), poly(vinylalcohol-co-acetal), poly(vinylalcohol-co-benzal), polystyrene, poly(vinylacetate), cellulose nitrate, cellulose acetate propionate, cellulose acetate hydrogen phthalate, cellulose acetate, cellulose acetate butyrate, cellulose triacetate, ethyl cellulose, poly(methylmethacrylate), copolymers of methylmethacrylate and polycarbonates. Especially preferred polycarbonates for use in the heat-resistant layer of the present invention are those described in European patent application no. 91202071.6, particularly polycarbonates derived from 1,1-bis-(4-hydroxyphenyl)-3,3,5-trimethylcyclohexane.

Heat-resistant layers according to the present invention can contain a lubricating material such as a surface active agent, a liquid lubricant, a solid lubricant or mixtures thereof. The surface active agents may be any agents known in the art such as carboxylates, sulfonates, phosphates, aliphatic amine salts, aliphatic quaternary ammonium salts, polyoxyethylene alkyl ethers, polyethyleneglycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Particularly preferred lubricants are polysiloxane-polyether copolymers and polytetrafluoroethylene. Suitable lubricants are described in e.g. U.S. Pat. Nos. 4,753,921, 4,916,112, 4,717,711, 4,717,712, 4,866,026, and 4,829,050.

The amount of lubricant used in the heat-resistant layer depends largely on the type of lubricant, but is generally in the range of from about 0.1 to 50 wt %, preferably 0.5 to 40 wt % of the binder or binder mixture employed.

The heat-resistant layer according to the present invention may contain other additives provided such materials do not inhibit the anti-stick properties of the heat-resistant layer and provided that such materials do not scratch, erode, contaminate or otherwise damage the printhead or harm image quality. Examples of suitable additives are described in EP 389153.

The heat-resistant layer of the thermal dye sublimation transfer donor element according to the present invention is formed preferably by adding the polymeric thermoplastic binder or binder mixture, the lubricant(s), and other optional components to a suitable solvent or solvent mixture, dissolving or dispersing the ingredients to form a coating composition that is applied to a support, which may have been provided first with an adhesive or subbing layer, and dried.

The heat-resistant layer of the dye-donor element may be coated on the support or printed thereon by a printing technique such as a gravure process.

The heat-resistant layer thus formed has a thickness of about 0.1 to 3 μm, preferably 0.3 to 1.5 μm.

As mentioned above the lubricants can be incorporated into the heat-resistant layer. Advantageously, however, a separate top layer comprising at least one lubricant is coated on top of the heat-resistant layer. Preferably, a top layer of a polyether-polysiloxane copolymer, optionally in combination with glycerol monostearate, is coated from a non-solvent for the heat-resistant layer on the latter layer. Another preferred separate top layer comprising lubricants has been described in European patent application no. 92200229.0.

Preferably a subbing layer is provided between the support and the heat-resistant layer to promote the adhesion between the support and the heat-resistant layer. As subbing layer any of the subbing layers known in the art for dye-donor elements can be used. Suitable binders that can be used for the subbing layer can be chosen from the classes of polyester resins, polyurethane resins, polyester urethane resins, modified dextrans, modified cellulose, and copolymers comprising recurring units such as i.a. vinylchloride, vinylidenechloride, vinylacetate, acrylonitrile, methacrylate, acrylate, butadiene, and styrene (e.g. poly(vinylidenechloride-co-acrylonitrile)). Suitable layers are described in e.g. EP 138483, EP 227090, U.S. Pat. Nos. 4,567,113, 4,572,860, 4,717,711, 4,559,273, 4,695,288, 4,727,057, 4,737,486, 4,965,239, 4,753,921, 4,895,830, 4,929,592, 4,748,150, 4,965,238 and 4,965,241. Preferably the subbing layer further comprises an aromatic polyol such as 1,2-dihydroxybenzene as described in EP 433496.

Especially preferred are subbing layers such as those described in European patent application no. 92200907.1. Herein, a subbing layer is disclosed comprising a polyester formed by polycondensation of at least one aromatic dicarboxylic acid and at least one aliphatic diol, wherein said polyester is a copolyester further comprising units derived from at least one multifunctional comonomer carrying at least 3 functional groups, which may be same or different and are chosen from hydroxy and carboxy groups including so-called latent carboxy groups. By the expression 'latent carboxy groups' an anhydride group is meant, which has been formed by ring closure using 2 carboxy groups, the anhydride group in this context thus accounting for 2 carboxy groups.

Any dye can be used in the dye layer of the dye-donor element of the present invention provided it is transferable to the dye-image-receiving layer by the action of heat. Examples of suitable dyes have been described in e.g. EP 432829, EP 400706, EP 485665, EP 453020, European patent application no. 91200218.5, and in the references cited in the above documents.

The ratio of dye or dye mixture to the binder ranges from 9:1 to 1:3 by weight, preferably from 3:1 to 1:2 by weight.

At least one of the following polymers can be chosen for use as a binder for the dye layer:cellulose derivatives e.g. ethyl cellulose, hydroxyethyl cellulose, ethylhydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, and cellulose triacetate; vinyl-type resins and derivates e.g. polyvinyl alcohol, polyvinyl acetate, polyvinyl butyral, poly(vinylbutyral-co-vinylacetal-co-vinylalcohol), polyvinyl pyrrolidone, polyvinyl acetoacetal, and polyacrylamide; polymers and copolymers derived from acrylates and acrylate derivatives e.g. polyacrylic acid, polymethyl methacrylate, and styrene-acrylate copolymers; polyester resins; polycarbonates; poly(styrene-co-acrylonitrile); polysulfones; polyphenylene oxide; organosilicones e.g. polysiloxanes; epoxy resins; natural resins e.g. gum arabic; and alkyd resins.

Preferably, the dye layer of the present invention comprises a poly(styrene-co-acrylonitrile).

The dye layer may also contain other additives such as e.g. thermal solvents, stabilizers, curing agents, preservatives, organic or inorganic fine particles, dispersing agents, antistatic agents, defoaming agents, and viscosity-controlling agents, these and other ingredients being described more fully in EP 133012, EP 111004 and EP 279467.

Especially preferred organic fine particles for use in the dye layer are polyethylene, polypropylene, or amide wax particles.

A dye-barrier layer comprising a hydrophilic polymer may also be provided in the dye-donor element between the support and the dye layer to prevent wrong-way transfer of dye towards the support and thus enhance the dye transfer density values. The dye barrier layer may contain any hydrophilic material that is useful for the intended purpose. In general, good results have been obtained with e.g. gelatin, polyacrylamide, polyisopropyl acrylamide, butyl methacrylate-grafted gelatin, ethyl methacrylate-grafted gelatin, ethyl acrylate-grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid, and a mixture of cellulose monoacetate and polyacrylic acid. Suitable dye barrier layers have been described in e.g. EP 227091 and EP 228065.

Any material can be used as the support for the dye-donor element provided it is dimensionally stable and capable of withstanding the temperatures involved, up to about 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper, and condenser paper. Preference is given to a support comprising polyethylene terephthalate. In general, the support has a thickness of 2 to 30 μm.

The support for the receiver sheet used in combination with the dye-donor element may be a transparent film of e.g. polyethylene terephthalate, a polyether sulfone, a polyimide, a cellulose ester, or a polyvinyl alcohol-co-acetal. The support may also be a reflective one such as baryta-coated paper, polyethylene-coated paper, or white polyester i.e. white-pigmented polyester. Blue-coloured polyethylene terephthalate film can also be used as a support.

To avoid poor adsorption of the transferred dye to the support of the receiver sheet this support should be coated with a special coating, called dye-image-receiving layer. This layer may comprise e.g. a polycarbonate, a polyurethane, a polyester, a polyamide, polyvinyl chloride, poly(styrene-co-acrylonitrile), and polycaprolactone or mixtures thereof. Suitable dye-image-receiving layers have been described in e.g. EP 133011, EP 133012, EP 144247, EP 227094, EP 228066. The dye-image-receiving layer may also comprise a cured binder such as the heat-cured product of poly(vinylchloride-co-vinyl acetate-co-vinyl alcohol) and polyisocyanate.

In order to improve the light resistance and other stabilities of recorded images, UV absorbers, singlet oxygen quenchers such as HALS-compounds (Hindered Amine Light Stabilizers) and/or antioxidants can be incorporated into the dye-image-receiving layer.

The dye layer of the dye-donor element and/or the dye-image-receiving layer of the receiver sheet may also contain a releasing agent that aids in separating the dye-donor element from the receiver sheet after transfer. The releasing agents can also be provided in a separate layer on at least part of the dye layer or of the dye-image-receiving layer. Solid waxes, fluorine- or phosphate-containing surfactants and silicone oils can be used as releasing agent. Suitable releasing agents have been described in e.g. EP 133012, JP 85/19138, and EP 227092.

The thermal dye sublimation transfer printing process comprises placing the dye layer of the donor element in face-to-face relation with the dye-image-receiving layer of the receiver sheet and image-wise heating from the back of the dye-donor element. The transfer of the dye is accomplished by heating for several milliseconds at about 400° C.

When the process is performed for but one single colour, a monochrome dye transfer image is obtained. A multicolour image can be obtained by using a dye-donor element containing three or more primary colour dyes and sequentially performing the process steps described above for each colour. The above sandwich of dye-donor element and receiver sheet is formed on three occasions during the time when heat is applied by the thermal printing head. After the first dye has been transferred, the elements are peeled apart. A second dye-donor element (or another area of the dye-donor element with a different dye area) is then brought in register with the receiving sheet and the process is repeated. The third colour and optionally further colours are obtained in the same manner.

In addition to thermal printing heads, laser light, infrared flash, or heated pens can be used as the heat source for supplying heat energy. Thermal printing heads that can be used to transfer dye from the dye-donor elements of the present invention to a receiver sheet are commercially available. In case laser light is used, the dye layer or another layer of the dye donor-element should contain a compound e.g. carbon black that absorbs the light emitted by the laser and converts it into heat.

Alternatively, the support of the dye-donor element may be an electrically resistive ribbon consisting of e.g. a multilayer structure of a carbon-loaded polycarbonate coated with a thin aluminium film. Current is injected into the resistive ribbon by electrically addressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology as compared to the thermal head technology, in which latter case the various elements of the thermal printing head get hot and must cool down before the head can move to the next printing position.

The following examples illustrate the invention in more detail without, however, limiting the scope thereof.

EXAMPLES

A dye-donor element for use according to thermal dye sublimation transfer was prepared as follows:

A solution comprising 8 wt % of dye A, 2.4 wt % of dye B, 6.4 wt % of dye C, 1% of an amide wax and 8 wt % of poly(styrene-co-acrylonitrile) as binder in methylethylketone as solvent was prepared. From this solution a layer having a wet thickness of 10 μm was coated on 6 μm thick polyethylene terephthalate film, provided with a conventional subbing layer. The resulting layer was dried by evaporation of the solvent.

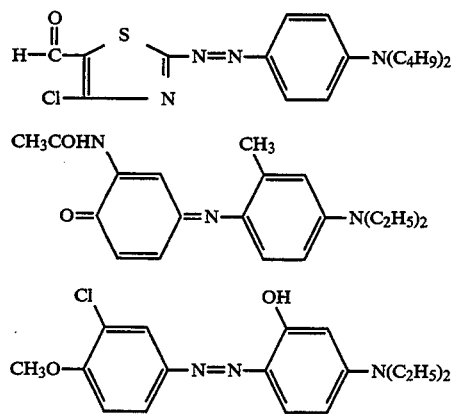

The back side of the polyethylene terephthalate film was provided with a subbing layer coated from a solution in methylethylketone comprising the ingredients as indicated in table 1 below.

On top of said subbing layer a heat-resistant layer and a topcoat layer were coated from a solution containing ingredients, the nature and amount of which is indicated below in table 1. Percentages are weight percentages in the coating solution. These solutions were coated at a wet thickness of 10 μm.

A receiving element for use according to thermal dye sublimation transfer was prepared as follows:

A receiving layer containing 7.2 g/m$^2$ poly(vinylchloride-co-vinylacetate-co-vinylalcohol) (VINYLITE VAGD supplied by Union Carbide), 0.72 g/m$^2$ diisocyanate (DESMODUR VL supplied by Bayer AG) and 0.2 g/m$^2$ hydroxy modified polydimethylsiloxane (TEGOMER H SI 2111 supplied by Goldschmidt) was provided on a 175 μm thick polyethylene terephthalate film.

The dye-donor element was printed in combination with the receiving element in a Mitsubishi color video printer CP100E.

After printing, the dye-donor element and dye receiving element were separated. The damage to the back side of the heat-resistant layer was visually inspected and the occurrence of 'smiles' on the printed image was evaluated. The stability of the dye-donor element was evaluated after storage at elevated temperatures (45°-60° C.) in rolled form during 1 week.

For all the above visual evaluations the following categories were established: poor (P), moderate (M), good (G) and excellent (E).

This experiment was repeated for each of the dye-donor elements identified in table 1 below. The amounts in table 1 are indicated in % by weight in coating solution (solvent is added up to 100%)

All subbing layers were coated from ethylmethylketone, heat-resistant layers were coated from ethylmethylketon (binder B1 to B5) or tetrahydrofurane (binder B6 and B7). The topcoat layer was casted from isopropanol.

TABLE I

| Ex.n° | Subbing layer | Heat-resistant layer | Topcoat layer | Damage | 'Smiles' | Storage Stability |
|---|---|---|---|---|---|---|
| COMP 1 | 1.5% A1 | 13% B1 | 0.5% Cl | P | M | P |
| COMP 2 | " | 13% B2 | 0.5% Cl | G | M | M |
| 1 | " | 13% B3 | 0.5% Cl | E | E | E |
| 2 | " | 13% B4 | 0.5% Cl | G | G | G |
| 3 | " | 13% B5 | 0.5% Cl | G | G | G |
| 4 | 1.5% A2 | 13% B3 | 0.5% Cl | E | E | E |
| 5 | 1.0% A2 1.5% A3 | 13% B3 | 0.5% Cl | E | E | G |
| 6 | 1.5% A1 | 7% B3, 6% B2 | 0.5% Cl | G | G | G |
| 7 | 1.5% A1 | 13% B6 | 0.5% Cl | E | E | E |
| 8 | 1.5% A1 | 13% B7 | 0.5% Cl | E | E | E |

A1: Copolyester comprising ethyleneglycol, neopentylglycol, terephtalic acid, isophtalic acid, adipic acid and glycerol
A2: Dynapol L206 (supplied by Goodyear)
A3: 1,3-dihydroxybenzene
B1: Poly(styrene-co-acrylonitrile) Luran 388S (supplied by BASF, Germany)
B2: Polycarbonate containing 45 mol % bisphenol A and 55 mol % of a bisphenol with the following structure

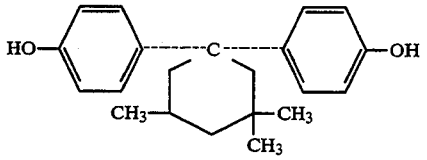

B3: Polycyanoarylether with the following structure

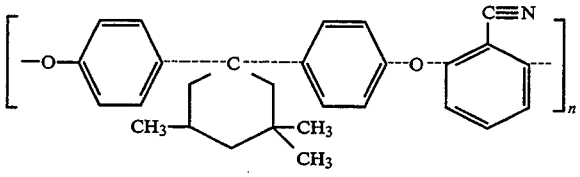

B4: Polycyanoarylether with the following structure

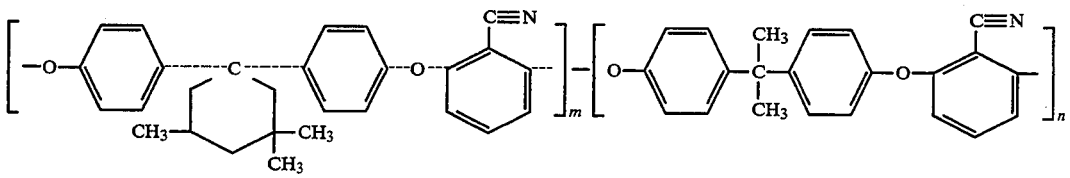

wherein m = 35 mol %
n = 65 mol %

TABLE I-continued

B5: Polycyanoarylether of B4 wherein m = 55 mol %
n = 65 mol %

B6: Polyetherketone having the following structure

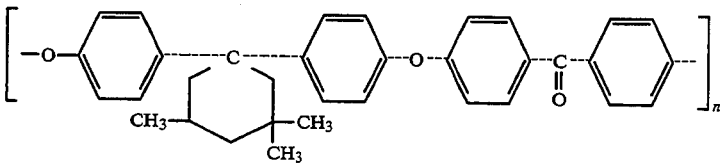

B7: Polyethersulfone having the following structure

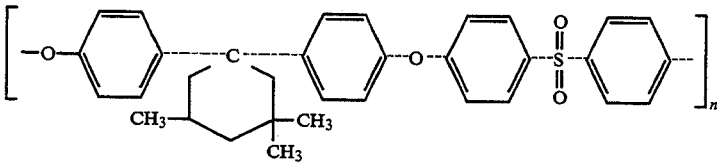

C1: Tegoglide 410 (supplied by Goldsmidt, Germany)

As can be seen from table 1, the heat-resistant layers of the present invention perform better than conventional heat-resistant layers. The heat stability of the heat-resistant layers of the present invention is high and little or no damage can be seen after printing. Moreover, a low friction coefficient against the thermal head results in the absence of 'smiles' in the printed image. The storage stability of the dye-donor element in rolled form is better than in conventional dye-donor elements.

We claim:

1. Dye-donor element for use according to thermal dye sublimation transfer comprising a support having on one side a dye layer and on the other side a heat-resistant layer, characterized in that said heat-resistant layer comprises a polyether containing at least 10 mol % recurring units corresponding to the following formula (I)

$$-O-E-O-E'- \quad (I)$$

wherein

—O—E—O— represents a divalent diphenolate radical corresponding to the following general formula (II)

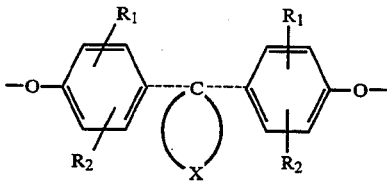

(II)

wherein $R_1$ and $R_2$ independently represent hydrogen, halogen, a $C_1$–$C_8$ alkyl group, a $C_5$–$C_6$ cycloalkyl group, a $C_6$–$C_{10}$ aryl group or a $C_7$–$C_{12}$ aralkyl group; and X represents the necessary atoms to close a 5- to 8-membered cycloaliphatic ring which may be substituted with one or more $C_1$–$C_6$ alkyl groups or 5- to 6-membered cycloalkyl groups or carry fused-on 5- or 6-membered cycloalkyl groups;

—E'— represents a divalent radical of an aromatic sulfone corresponding to the following general formula (III)

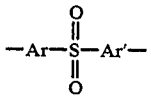

(III)

or a divalent radical of a diarylketone corresponding to the following general formula (IV)

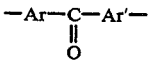

(IV)

or a divalent radical of benzonitrile corresponding to the following general formula (V)

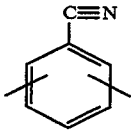

(V)

wherein Ar and Ar' in formula III and IV independently represent difunctional aromatic radicals having 6 to 50 carbon atoms.

2. Dye-donor element according to claim 1, wherein —E'— represents a divalent radical of benzonitrile corresponding to the following formula

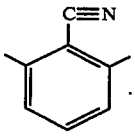

3. Dye-donor element according to claim 1, wherein —E'— represents a divalent radical of benzophenone corresponding to the following formula

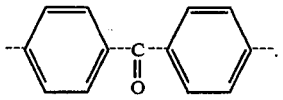

4. Dye-donor element according to claim 1, wherein —E'— represents a divalent radical represented by the following formula

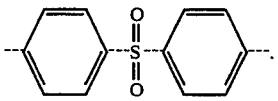

5. Dye-donor element according to claim 1, wherein —O—E—O— represents a divalent diphenolate radical corresponding to the formula (VI)

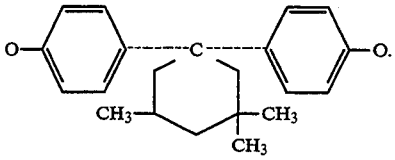

(VI)

6. Dye-donor element according to claim 1, wherein said polyether is present in an amount of at least 10% by weight.

7. Dye-donor element according to claim 1, wherein said heat-resistant layer further comprises a polycarbonate derived from 1,1-bis-(4-hydroxyphenyl)-3,3,5-trimethylcyclohexane.

8. Dye-donor element according to claim 1, wherein said heat-resistant layer further comprises a lubricant.

9. Dye-donor element according to claim 1, wherein a topcoat layer comprising lubricants is further provided on the heat-resistant layer.

10. Dye-donor element according to claim 9, wherein said topcoat comprises a polyether-polysiloxane block-copolymer.

11. Dye-donor element according to claim 1, wherein a subbing layer is provided between the heat-resistant layer and the support.

12. Dye-donor element according to claim 11, wherein said subbing layer comprises a polyester formed by polycondensation of at least one aromatic dicarboxylic acid and at least one aliphatic diol, wherein said polyester is a copolyester further comprising units derived from at least one multifunctional comonomer carrying at least 3 functional groups, which may be same or different and are chosen from hydroxy and carboxy groups including so-called latent carboxy groups.

* * * * *